US006406040B1

(12) United States Patent
Thorne

(10) Patent No.: US 6,406,040 B1
(45) **Date of Patent: *Jun. 18, 2002**

(54) HIGHBACK SNOWBOARD BINDING

(75) Inventor: James Thorne, Portland, OR (US)

(73) Assignee: Nike, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/176,341

(22) Filed: Oct. 21, 1998

(51) Int. Cl.[7] ..... B62B 9/04

(52) U.S. Cl. ..... 280/14.21; 280/613; 280/618; 36/117.1

(58) Field of Search ..... 280/14.21, 14.22, 280/617, 11.36, 626, 631, 618, 619, 604; 36/117.1, 118.1

(56) References Cited

U.S. PATENT DOCUMENTS 4,081,186 A * 3/1978 Beyl ..... 280/618
4,711,042 A * 12/1987 Morell et al. ..... 36/118.1
5,692,765 A 12/1997 Laughlin ..... 280/619
5,713,587 A 2/1998 Morrow et al. ..... 280/14.2
5,727,797 A * 3/1998 Bowles ..... 280/14.2
5,816,602 A * 10/1998 Hayashi ..... 280/604
5,901,971 A * 5/1999 Eaton ..... 280/14.2
5,975,557 A * 11/1999 Snoke et al. ..... 280/624
6,027,136 A * 2/2000 Phillips ..... 280/618
6,155,577 A * 12/2000 Okajima ..... 280/14.2

OTHER PUBLICATIONS

K2 Product Brochure, Title and Date Unknown.

* cited by examiner

*Primary Examiner*—Lanna Mai
*Assistant Examiner*—Hau Phan
(74) *Attorney, Agent, or Firm*—Banner & Witcoff, Ltd.

(57) ABSTRACT

A binding has a heel loop and a highback pivotally connected to the heel loop. A lever mechanism has a first portion pivotally connected to the highback and a second portion which operably engages the heel loop. Rotation of the lever mechanism causes the highback to move between a neutral position and a forward lean position. In certain preferred embodiments, the first portion of the lever mechanism is adjustably pivotally connected to the highback. In certain preferred embodiments, the second portion of the lever mechanism is secured to the heel loop.

13 Claims, 6 Drawing Sheets

HIGHBACK SNOWBOARD BINDING

INTRODUCTION

The present invention is directed to a snowboard binding, and, more particularly, to a snowboard binding having an improved mechanism for positioning the highback portion of the binding.

BACKGROUND

Current snowboard bindings may be of a step-in configuration where the snowboard user (hereinafter "snowboarder") merely steps down onto the binding, and a step-in mechanism attaches the snowboarder's boot to the snowboard. Other snowboard bindings may have straps which wrap around the instep and toe of the snowboarder's boot, securing the boot to the binding. Both the step-in and strap bindings typically have a highback portion which is positioned behind the snowboarder's boot. During use, the highback portion is in a forward lean position.

U.S. Pat. No. 5,692,765 to Laughlin shows a snowboard binding with a highback portion. When a snowboarder steps into the Laughlin binding and pushes downward on a latch, the highback portion moves into the forward lean position. The binding of Laughlin requires a complex system of cables which run through its highback and base plate to engage instep and toe straps on the front portion of the binding. Releasing the latch on the highback of the binding of Laughlin also releases the straps, thereby releasing the snowboarder's boot from the binding, rendering the binding inoperative.

It is an object of the present invention to provide a highback snowboard binding which reduces or wholly overcomes some or all of the aforesaid difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a snowboard binding having an improved mechanism for positioning the highback portion of the binding.

In accordance with a first aspect, a snowboard binding has a heel loop and a highback pivotally secured to the heel loop. A lever mechanism has a first portion pivotally connected to the highback and a second portion which operably engages the heel loop.

In accordance with a second aspect, a snowboard binding has a heel loop and a highback pivotally secured to the heel loop. A first support member operably engages the heel loop. A second support member is secured to the highback. A lever arm is pivotally connected at a first end thereof to one of the first support member and the second support member. A link arm has a first end and a second end, the first end being pivotally connected to the lever arm, the second end being pivotally connected to the other one of the first support member and the second support member. When the first arm is pivoted about its first end, the highback moves from a neutral position to a predetermined forward leaning position.

From the foregoing disclosure, it will be readily apparent to those skilled in the art, that the present invention provides a significant technological advance. Preferred embodiments of the snowboard binding of the present invention can provide ease of entry into the binding, as well as allowing a snowboarder to move the highback to the more comfortable neutral position while their boot is still engaged with the binding. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
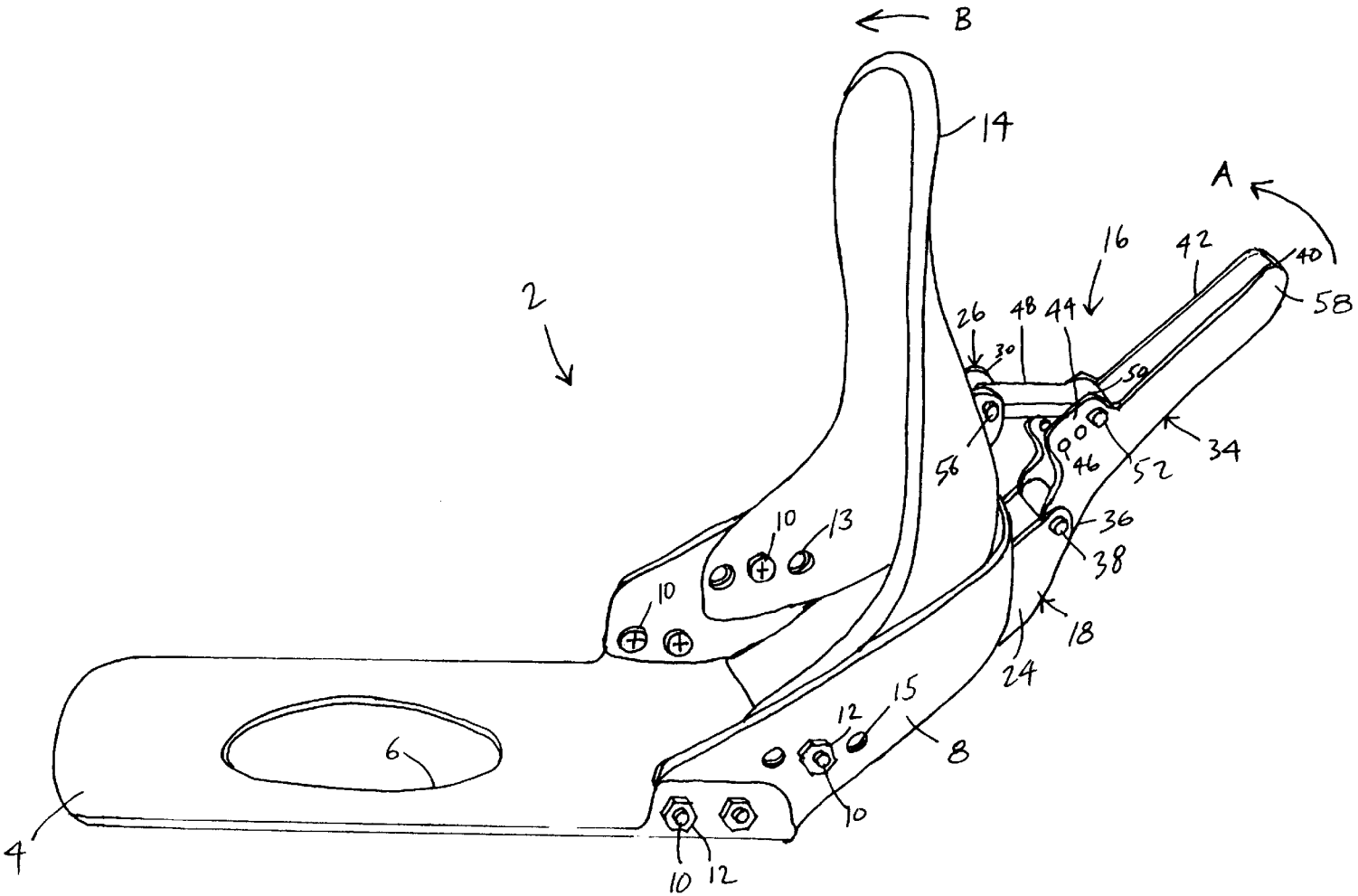
FIG. 1 is a schematic perspective view of a highback binding according to the present invention, shown in a neutral position.

The figures referred to above are not drawn necessarily to scale and should be understood to present a representation of the invention, illustrative of the principles involved. Some features of the highback snowboard binding depicted in the drawings have been enlarged or distorted relative to others to facilitate explanation and understanding. The same reference numbers are used in the drawings for similar or identical components and features shown in various alternative embodiments. Highback snowboard bindings as disclosed herein, will have configurations and components determined, in part, by the intended application and environment in which they are used.

DETAILED DESCRIPTION OF CERTAIN PREFERRED EMBODIMENTS

Referring to FIG. 1, a preferred embodiment of a snowboard binding according to the present invention is shown generally by reference numeral 2. Binding 2 comprises base plate 4 which mounts to a snowboard (not shown) via a mounting plate (not shown) which cooperates with aperture 6 in base plate 4 to allow for longitude or latitude adjustment of base plate 4 on the snowboard, and also allows for rotational adjustments of base plate 4. The snowboarder's boot is typically secured to the binding by a step-in mechanism, or straps secured about the insole and toe of the boot (not shown). These types of mechanisms for securing a boot to a binding are well known to those skilled in the art and further discussion need not be provided.

A heel loop 8 is secured to base plate 4 by screws 10 and nuts 12, or other suitable fasteners. It is to be appreciated that, in certain preferred embodiments, heel loop 8 may be unitary with base plate 4, that is, heel loop 8 and base plate 4 may be of one-piece construction. Highback 14 is pivotally secured to heel loop 8 via screws 10 and nuts 12, or other suitable fasteners which allow for rotational movement of highback 14 forward and back with respect to heel loop 8. Screws 10 extend through a corresponding pair of apertures 13, 15 in highback 14 and heel loop 8, respectively. A plurality of apertures 13, 15 are provided, in certain preferred embodiments, in at least one of highback 14 and heel loop 8 to allow for the rotation of highback 14 about a vertical axis with respect to binding 2 and heel loop 8. This allows a snowboarder to adjust the position of highback 14, and thus, their boot, with respect to binding 2 depending on desired performance characteristics.

Figure 2:
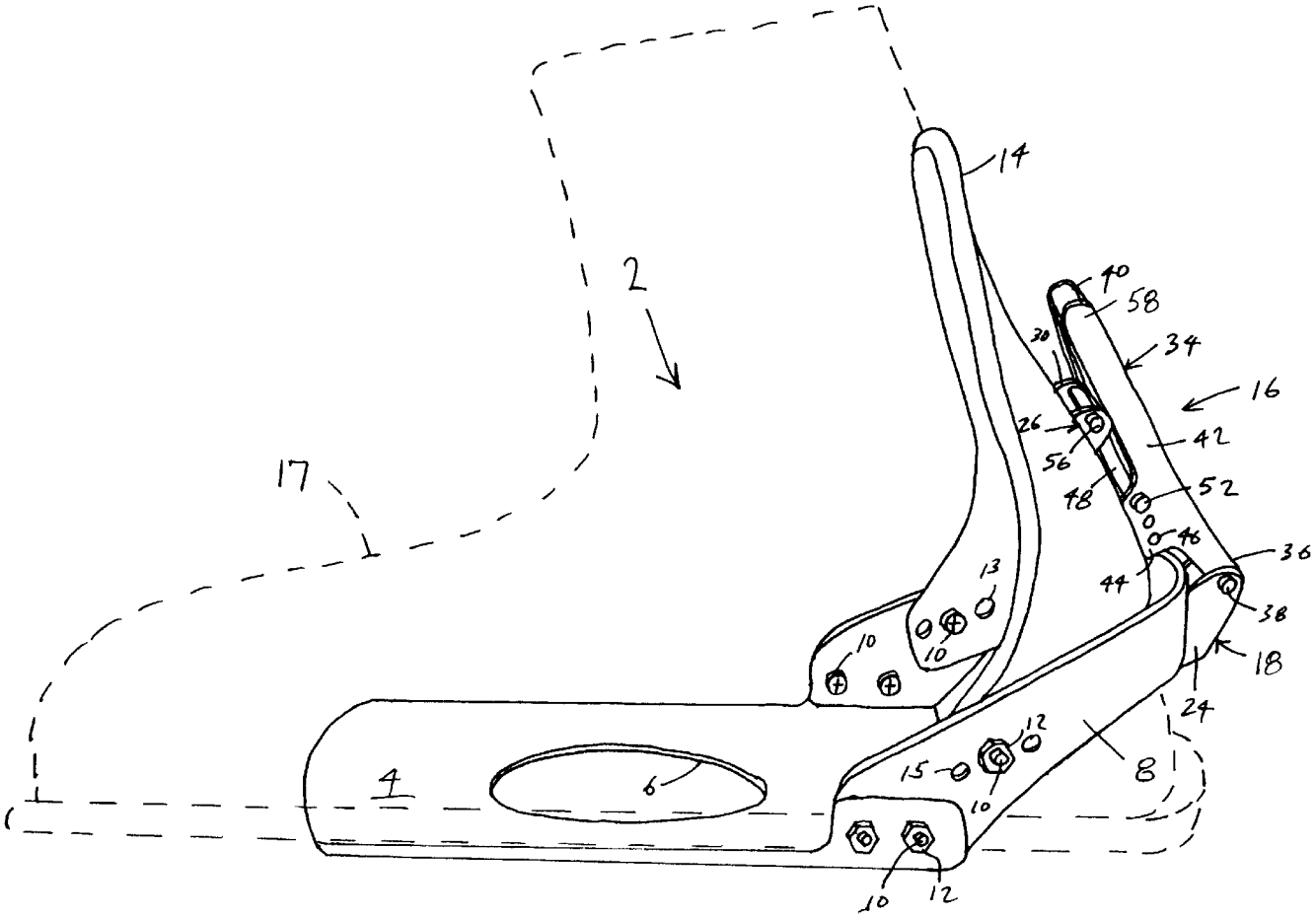
FIG. 2 is a schematic perspective view of the highback binding of FIG. 1, shown in a forward lean position.

Lever mechanism 16 is provided at a rear portion of binding 2 for moving highback 14 from a neutral position, as shown in FIG. 1, to a forward lean position, as shown in FIG. 2, where boot 17 is shown in dashed lines. The forward lean position is the typical orientation of highback 14 during use of the snowboard. Highback 14 wraps around the rear portion of the snowboarder's boot and leg, providing support in a position which enhances handling and performance of the snowboard. In certain preferred embodiments, highback 14 is in a substantially upright position when in the neutral position. The neutral position allows a snowboarder to easily place their boot into the step-in mechanism, or, alternatively, secure the straps around their boot, without the need to have the leg of the snowboarder in the forward leaning position. Thus, the present invention provides ease of entry into binding 2 for the snowboarder. Additionally, since highback 14 can move from the neutral position to the forward lean position independently of the mechanism which retains the boot, i.e., step-in mechanism or straps, the user can move highback 14 to the more comfortable neutral position while waiting in lift lines, while riding a lift, or at other times when the snowboarder prefers having highback 14 out of the forward lean position but wishes their boot to remain secured to the snowboard.

Figure 3:
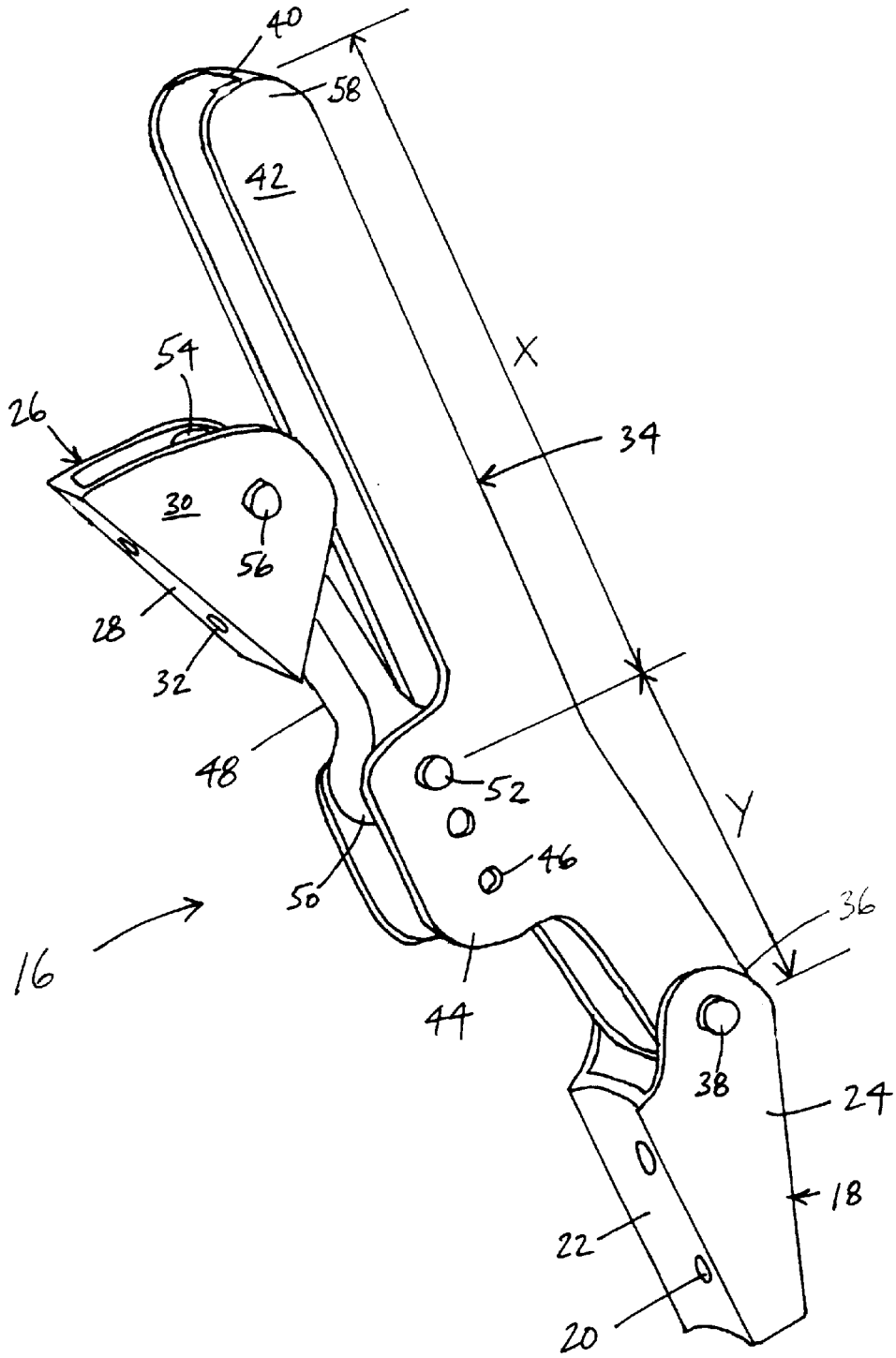
FIG. 3 is a schematic perspective view of the lever mechanism of FIG. 1.

Lever mechanism 16, seen in FIGS. 1–3, comprises first support member 18 which is secured to a rear portion of heel loop 8 via suitable fasteners (not shown) such as rivets. The fasteners extend through apertures 20 formed in first support member 18. As seen in FIG. 3, first support member 18 preferably is formed of a base 22 and a pair of opposed side walls 24 which together form a substantially U-shaped profile for first support member 18. In a preferred embodiment, base 22 is slightly concave in order to closely mate with the arcuate profile of the rear of heel loop 8 to which it is secured. Second support member 26 is similarly formed of a base 28 and a pair of opposed side walls 30, forming a substantially U-shaped profile. Second support member 26 is secured to a rear of highback 14 via suitable fasteners which extend through apertures 32 formed in base 28.

Figure 4:
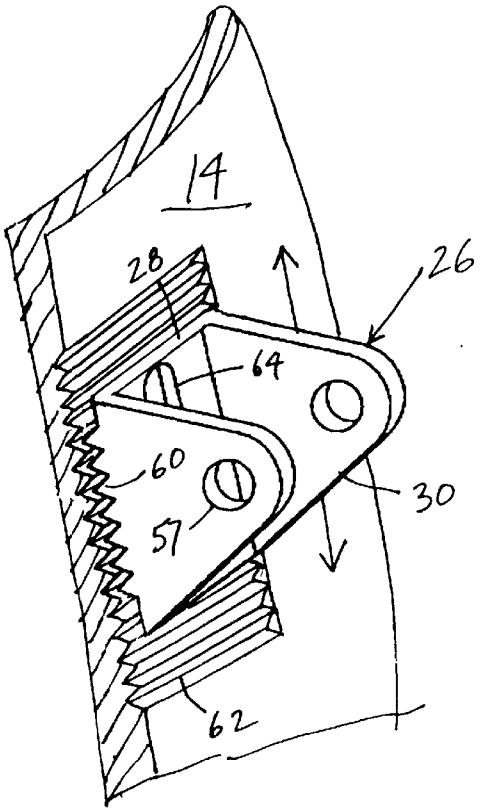
FIG. 4 is a schematic perspective view, shown partially broken away, of an alternative embodiment of the second support member of the highback binding of FIG. 1.

Lever arm 34 is pivotally connected at a first end 36 thereof to first support member 18 via pivot pin 38 which extends through a pair of apertures formed in side walls 24 of first support member 18. Lever arm 34 is preferably formed of a base 40 and a pair of opposed side walls 42, forming a substantially U-shaped profile. Flanges 44 extend outwardly from side walls 42 and have a plurality of apertures 46 formed therein. Link arm 48 is pivotally connected at a first end 50 thereof to lever arm 34 via pivot pin 52 which extends through a corresponding pair of apertures 46 in flanges 44. Link arm 48 is pivotally connected at a second end 54 thereof to second support member 26 via pivot pin 56 which extends through a pair of apertures 57, seen in FIG. 4, formed in side walls 30 of second support member 26. Pivot pins 38, 52, 56 may be spring-loaded pins, a nut and bolt, screws, rivets, or any other suitable mechanism for pivotally connecting the support members 18, 26 to lever arm 34 and link arm 48, respectively, as well as lever arm 34 to link arm 48. Such mechanisms will be readily apparent to those skilled in the art given the benefit of this disclosure.

In operation, a snowboarder places their boot into the step-in mechanism or engages the straps of binding 2. Lever arm 34 is then rotated upwardly about pivot pin 38 in the direction A shown in FIG. 1 by grasping second end 58 of lever arm 42 and pulling upwardly. Link arm 48 necessarily pivots downwardly about pivot pin 56 as lever arm 34 is rotated until an over center position is reached. Accordingly, highback 14 is moved in the direction of arrow B from its neutral position, shown in FIG. 1, to its forward lean position, shown in FIG. 2. Thus, a four bar linkage is formed of highback 14, heel loop 8, lever arm 34, and link arm 48 which provides for the movement of highback 14 between its neutral and forward lean positions.

In a preferred embodiment, the distance X, seen in FIG. 3, between pivot pin 52 and second end 58 of lever arm 34, is greater than the distance Y, between pivot pin 52 and pivot pin 38, providing a mechanical advantage when pivoting lever arm 34, and, necessarily, moving highback 14 to a desired forward lean position.

Lever mechanism 16 may be adjusted by moving pivot pin 52 from one corresponding pair of apertures 46 to another corresponding pair. In the embodiment depicted in FIGS. 1–3, there are three apertures 46 formed in each flange 44. Locating pivot pin 52 in the uppermost pair of apertures 46, as illustrated, provides the greatest throw for highback 14, where throw is defined as the angle between highback 14 in its neutral position and highback 14 in its forward lean position. Conversely, locating pivot pin 52 in the lowermost pair of apertures 46 provides the least amount of throw for lever arm 34. In the preferred embodiment shown in FIG. 3, the lowermost aperture 46 provides a throw of approximately 10°, the middle aperture 46 provides a throw of approximately 20°, and the uppermost aperture 46 provides a throw of approximately 30° between the neutral and forward lean positions of highback 14. The mechanical advantage of lever arm 34 also varies with the position of pivot pin 52. Locating pivot pin 52 in the uppermost aperture 46 reduces distance X while increasing distance Y, thereby reducing the mechanical advantage. Necessarily, locating pivot pin 52 in the lowermost aperture 46 increases distance X, while decreasing distance Y, thereby increasing the mechanical advantage provided.

Second support member 26, in certain preferred embodiments, is adjustably secured to highback 14. That is, second support member 26 can be secured at different positions along highback 14. As seen in the embodiment shown in FIG. 4, teeth 60 are formed on the surface of base 28. Teeth 60 engage corresponding teeth 62 formed on the rear portion of highback 14. Second support member 26 may be moved vertically, as shown by the arrows, along highback 14 to a desired location at which point second support member 26 is positioned such that corresponding teeth 60 and 62 mesh with one another. Second support member 26 is then secured to highback 14 via a fastener, e.g. a screw with a fixed nut attached thereto, extending through slot 64 formed in base 28. Locating second support member 26 at different points along highback 14 adjusts the neutral position and the forward lean position of highback 14 relative to binding 2. Specifically, locating second support member 26 at a lower point on highback 14 results in the neutral and forward lean positions being more forward relative to binding 2, while locating second support member 26 at a higher point on highback 14 results in the neutral and forward lean positions being more rearward relative to binding 2.

Figure 5:
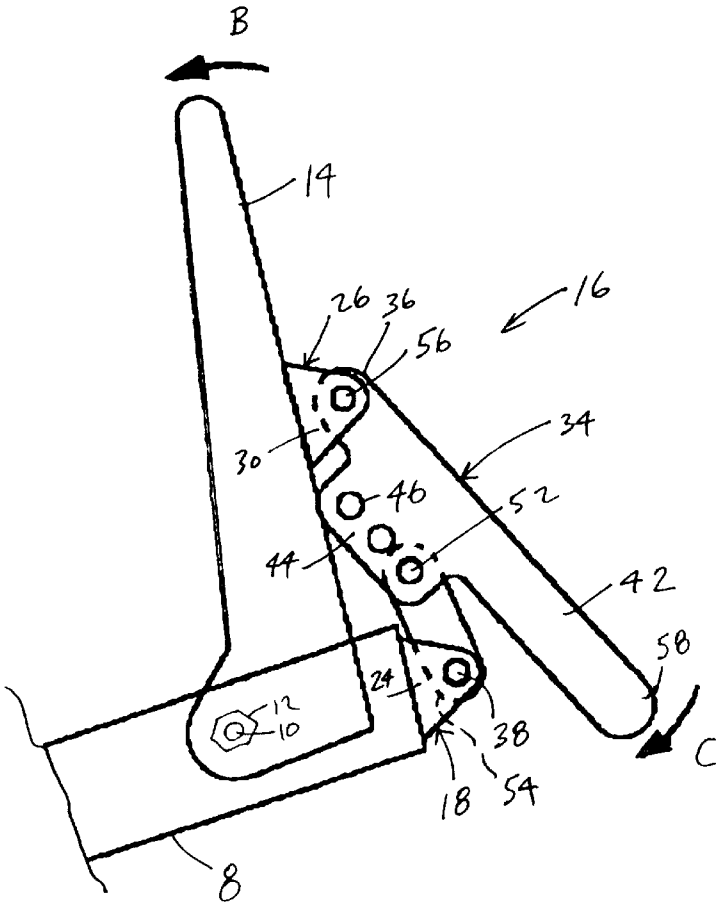
FIG. 5 is a schematic diagram of an alternative embodiment of the highback binding of FIG. 1.

Another embodiment of binding 2 is shown diagrammatically in FIG. 5. In this embodiment, lever arm 34 is inverted such that when lever arm 34 is pivoted downwardly in the direction of arrow C, the same objective is accomplished, that is, highback 14 moves in the direction of arrow B to the forward lean position. In this embodiment, first end 36 of lever arm 34 is pivotally connected via pivot pin 56 to second support member 26. Second end 54 of link arm 48 is pivotally connected via pin 38 to first support member 18. Thus, the same mechanical advantage described with respect to FIGS. 1–3 can be realized in this embodiment by pushing downwardly on second end 58 of lever arm 34.

Figure 6:
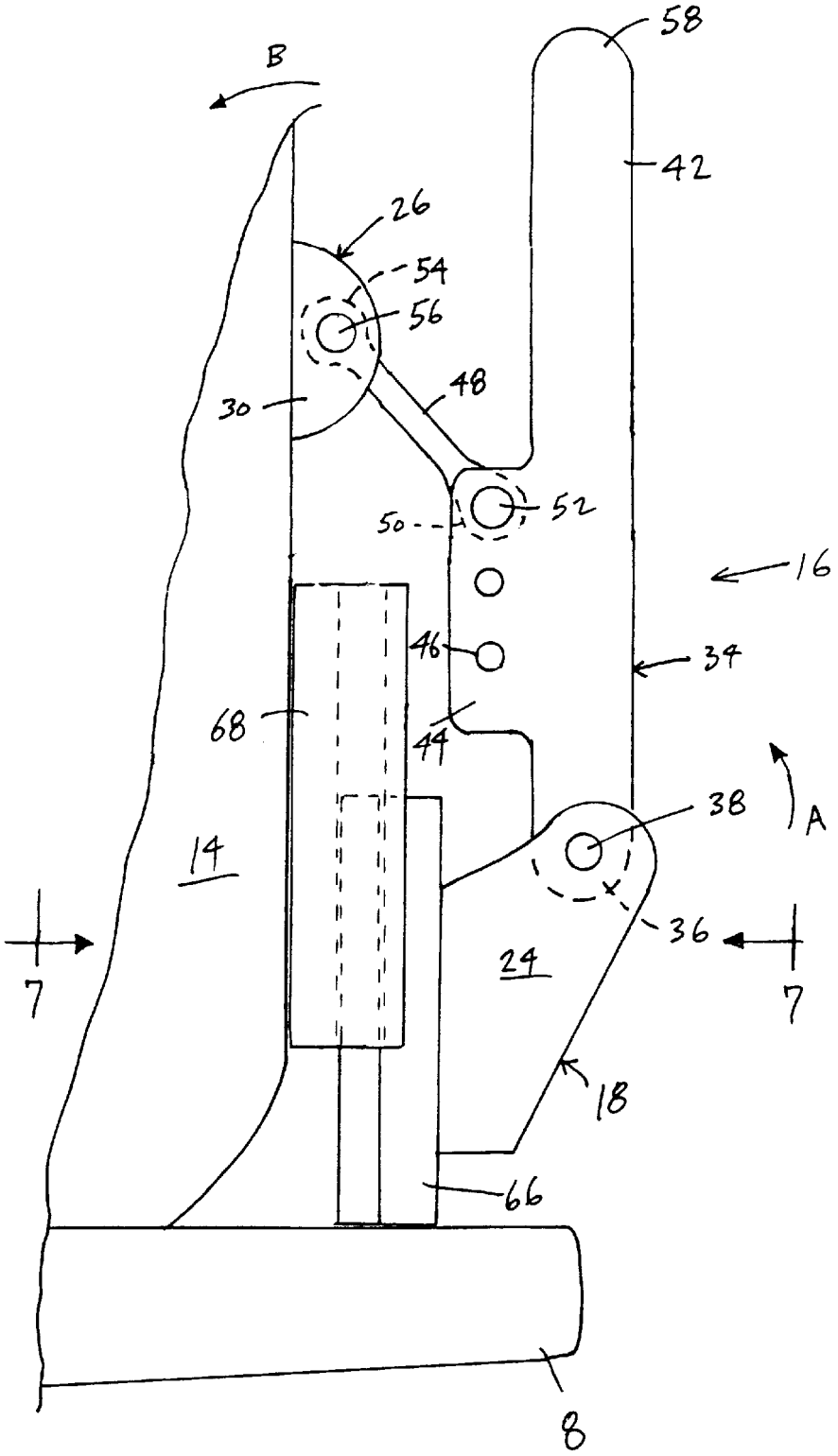
FIG. 6 is a schematic elevation view, shown partially broken away, of an alternative embodiment of the highback binding of FIG. 1.
Figure 7:
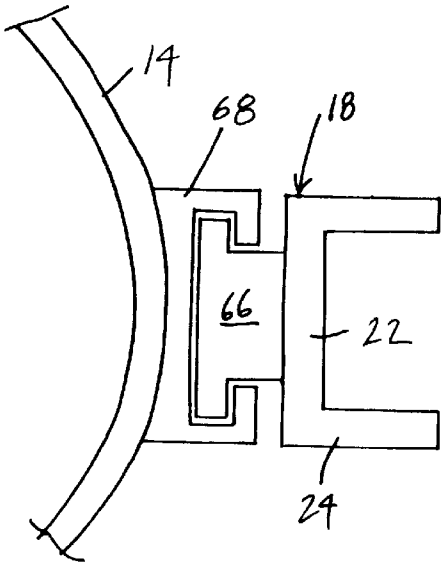
FIG. 7 is a schematic section view of the first support member of FIG. 6, taken along line 7–7 of FIG. 6, and shown partially broken away.
Figure 1:
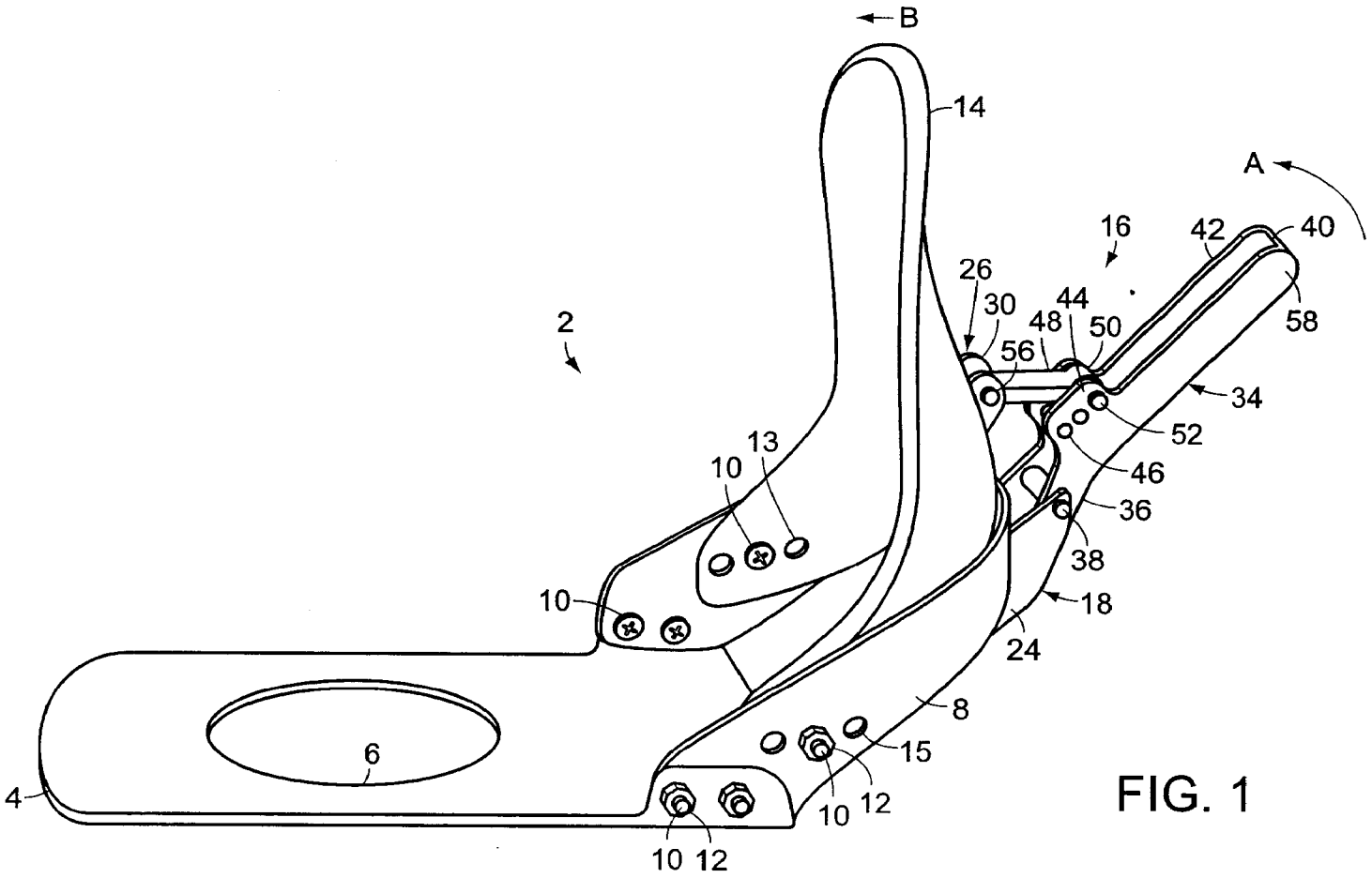
Figure 2:
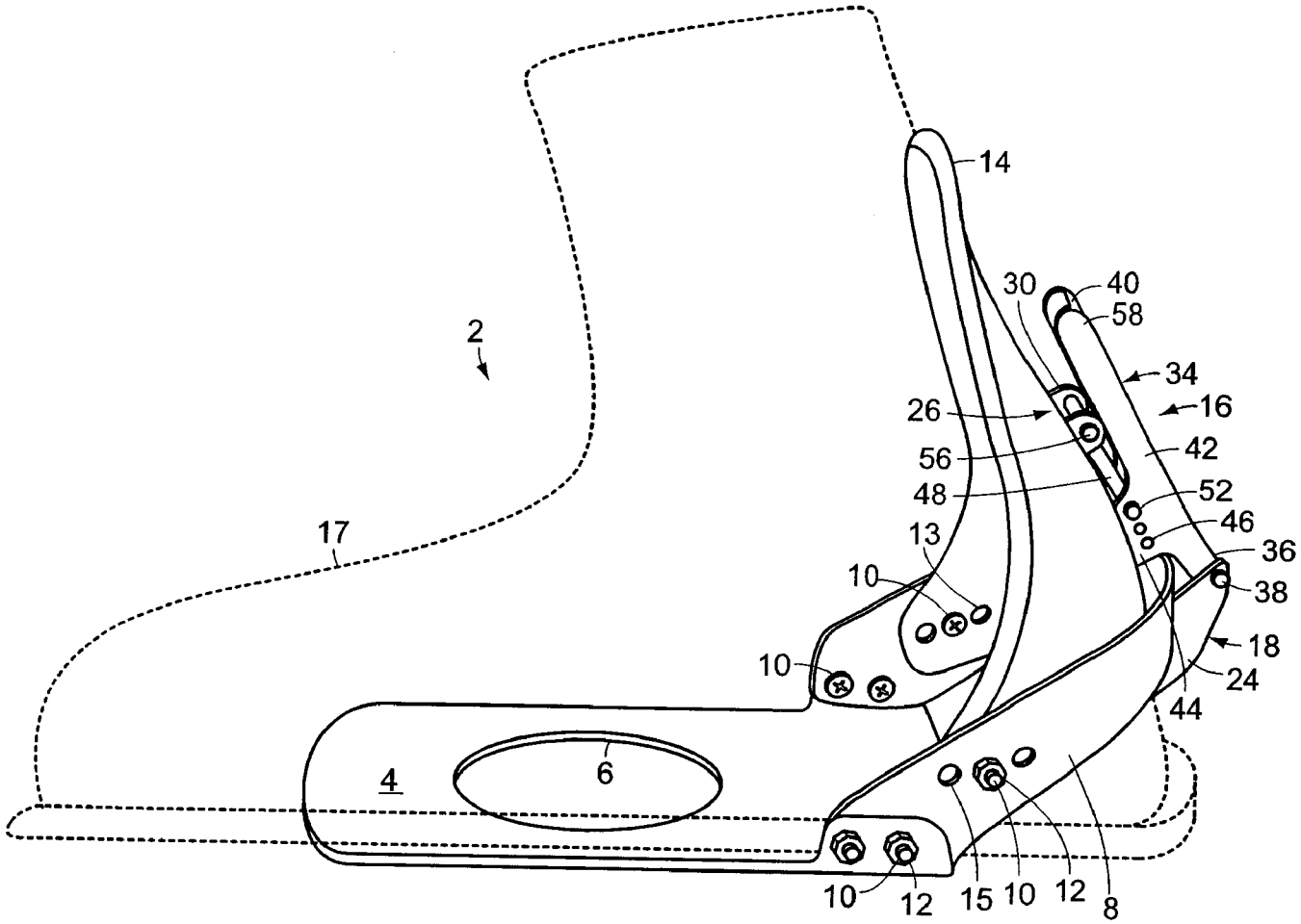
Figure 3:
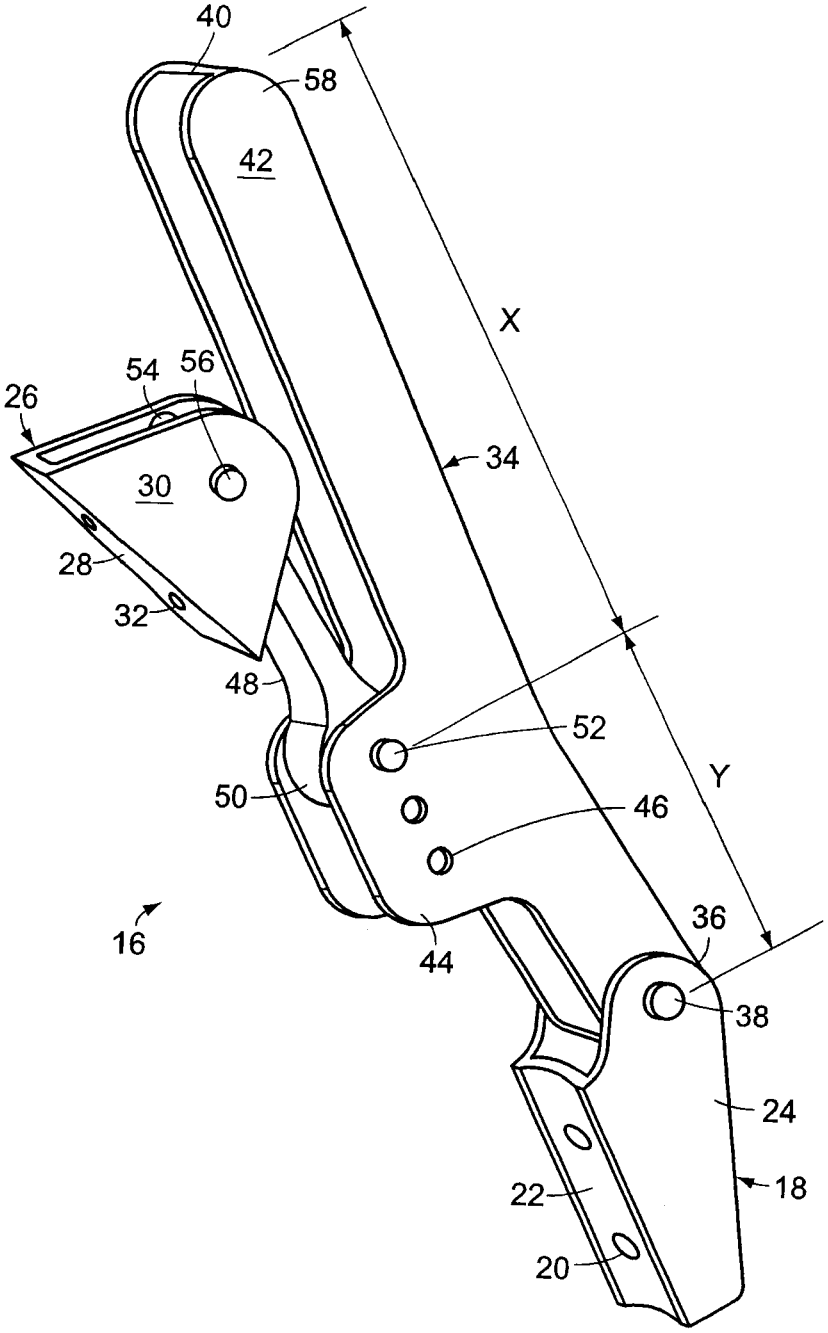
Figure 5:
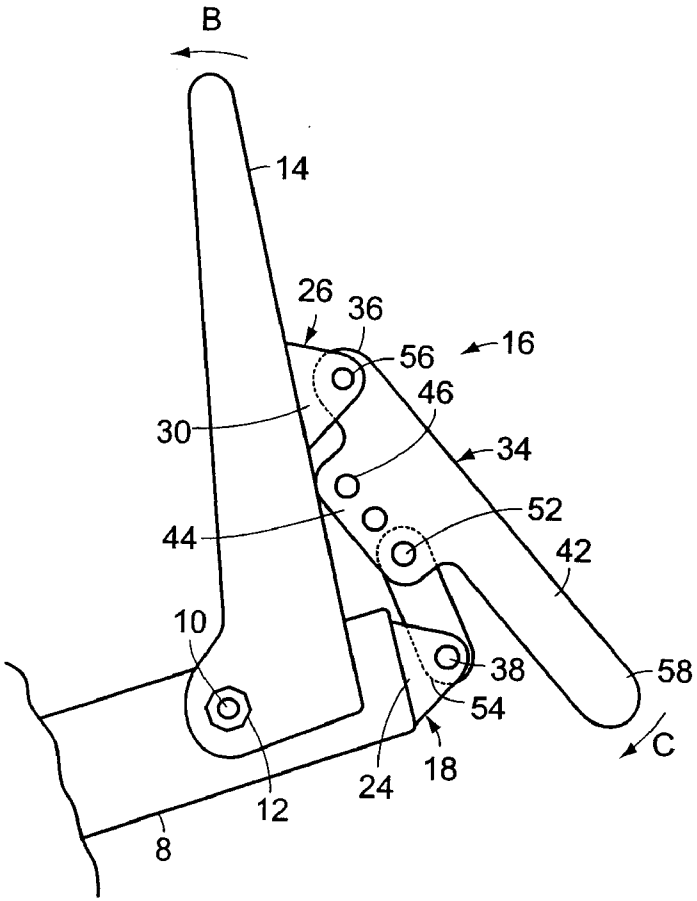
Figure 4:
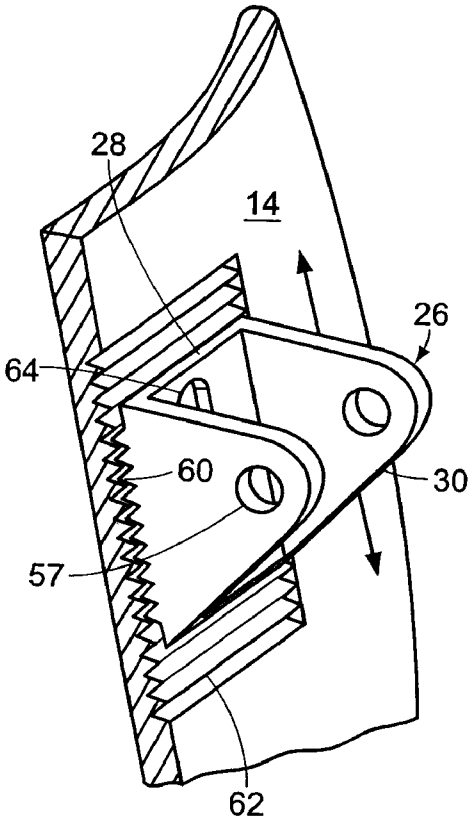
Figure 6:
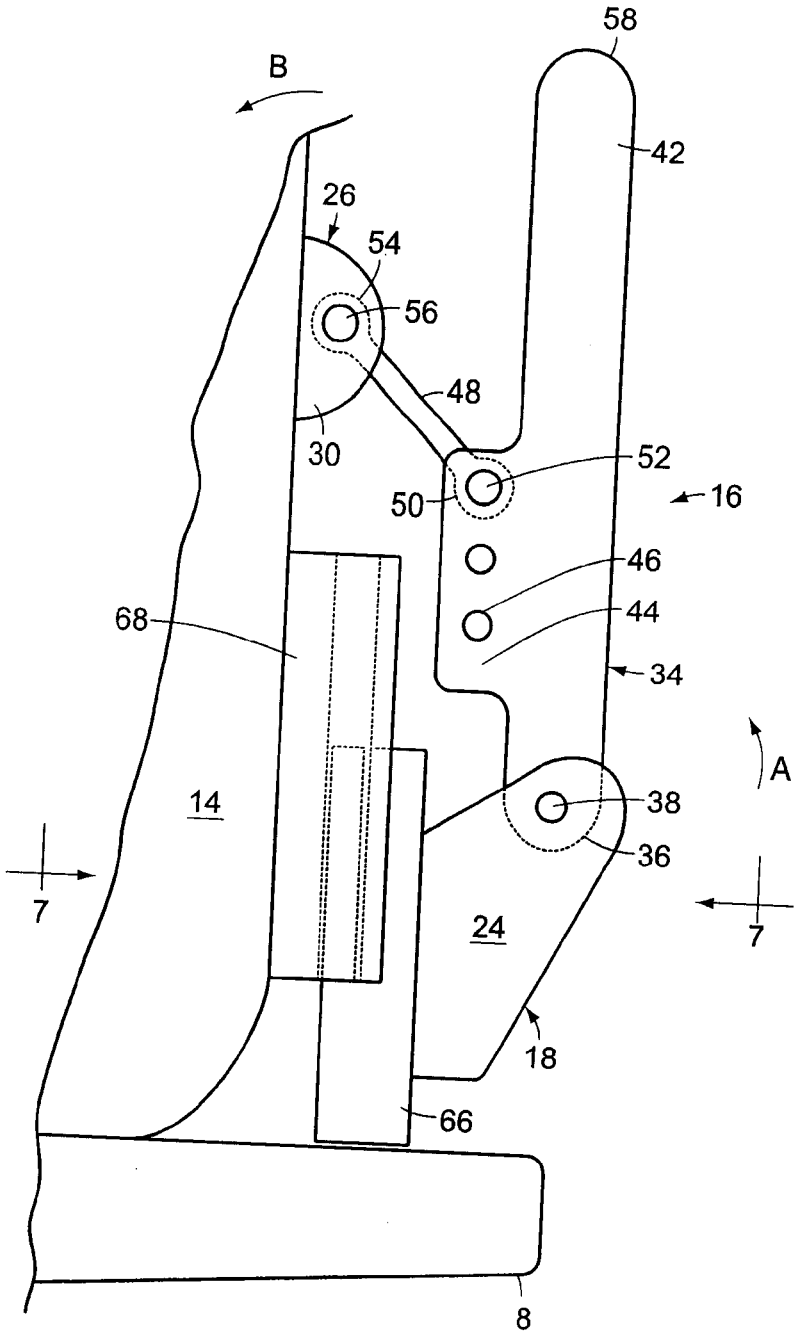
Figure 8:
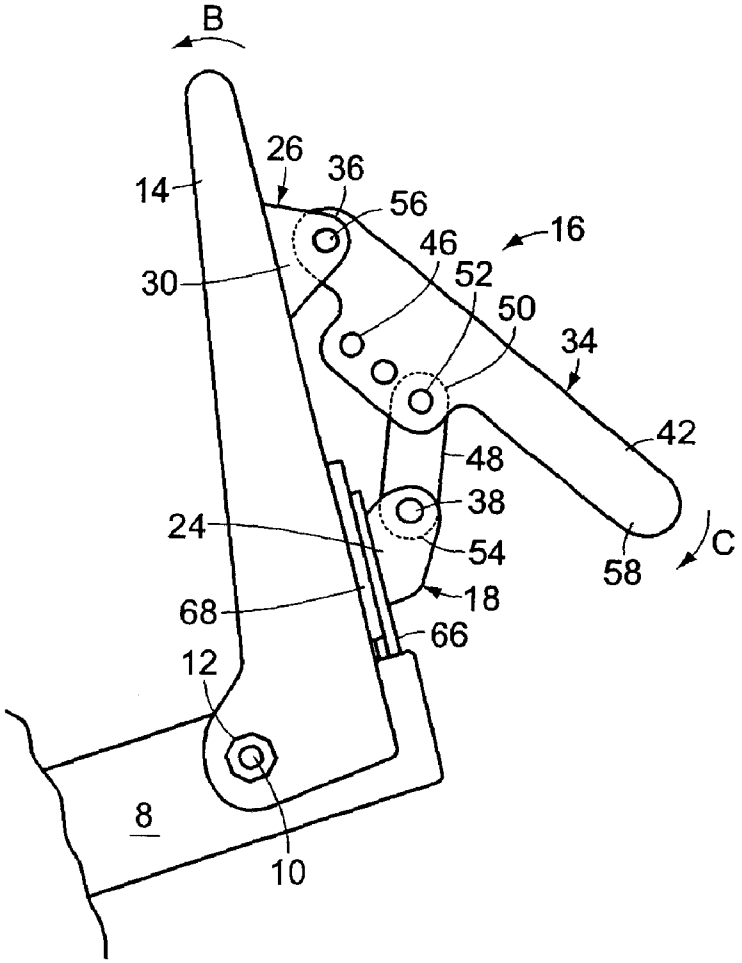
Figure 7:
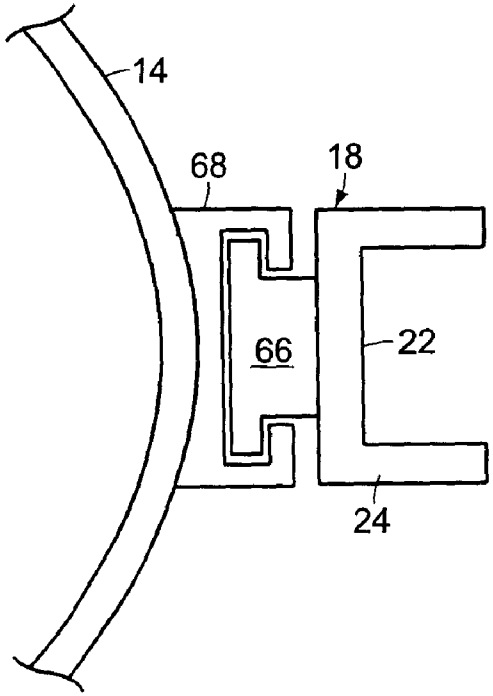

Another embodiment of binding 2 is shown in FIGS. 6, 7. In this embodiment, first support member 18 is slidably connected to highback 14 and engages heel loop 8 when lever arm 34 is pivoted. First support member 18 is pivotally connected to first end 36 of lever arm 34 via pin 38, but is not directly secured to heel loop 8. A projection 66 is secured to first support member 18 and a guide member 68 is secured to highback 14. Projection 66 slidingly engages guide member 68 to allow first support member 18 to travel up and down along the rear of highback 14. In a preferred embodiment, projection 66 has a substantially T-shaped profile and guide member 68 has a substantially C-shaped profile, such that projection 66 is received by the channel of guide member 68 and moves within guide member 68 in a vertical direction. As can be seen in FIG. 6, when second end 58 of lever arm 34 is pivoted upwardly about pivot pin 38 in the direction of arrow A, projection 66 moves downwardly within guide member 68 until it engages heel loop 8. As second end 58 continues its upward path, highback 14 moves in the direction of arrow B to its forward lean position. It is to be appreciated that in certain preferred embodiments, guide member 68, projection 66 and first support member 18 may be positioned such that first support member 18 engages heel loop 8 as lever arm 34 is pivoted. This embodiment advantageously allows highback 14 to be folded forward when not in use, since first support member 18 is not rigidly secured to heel loop 8. Folding highback 14 forward provides a reduced height of binding 2, which can aid in transportation of the snowboard.

Figure 8:
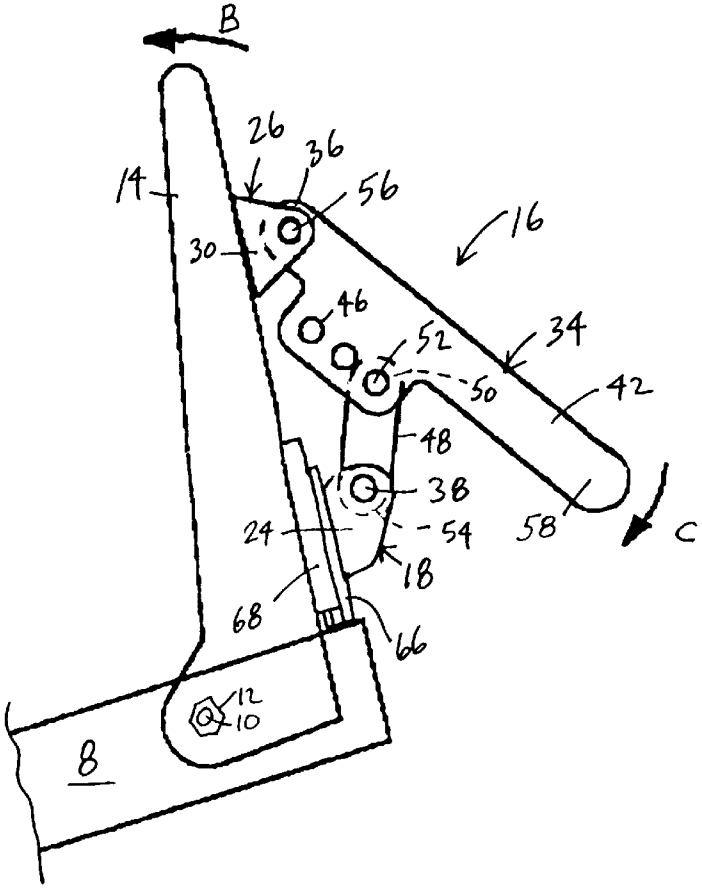
FIG. 8 is a schematic diagram of an alternative embodiment of the highback binding of FIG. 6.

Another embodiment of the binding 2 illustrated in FIGS. 6, 7 is shown diagrammatically in FIG. 8. In this embodiment, lever arm 34 is inverted such that when lever arm 34 is pivoted downwardly in the direction of arrow C, the same objective is accomplished, that is, highback 14 moves in the direction of arrow B to the forward lean position. In this embodiment, first end 36 of lever arm 34 is pivotally connected via pivot pin 56 to second support member 26. Second end 54 of link arm 48 is pivotally connected via pin 38 to first support member 18. Thus, the same mechanical advantage described with respect to FIGS. 6, 7 can be realized in this embodiment by pushing downwardly on second end 58 of lever arm 34.

In light of the foregoing disclosure of the invention and description of the preferred embodiments, those skilled in this area of technology will readily understand that various modifications and adaptations can be made without departing from the true scope and spirit of the invention. All such modifications and adaptations are intended to be covered by the following claims.

What is claimed is:

1. A snowboard binding comprising, in combination:

a base plate for attachment to a snowboard;

a snowboard binding heel loop configured to wrap around a heel of a boot, forward ends of the heel loop being rigidly attached to the base plate;

a first support member at a rear portion of the heel loop;

a highback pivotally secured to the heel loop;

a second support member at a rear portion of the highback; and a lever mechanism provided at a rear portion of the snowboard binding having a lever arch and a link arm connected to the lever arm, a first portion of the lever mechanism pivotally connected to the second support member and a second portion of the lever mechanism pivotally secured to the first support member such that rotation of the lever arm moves the highback between a neutral non-use position and a forward lean use position, wherein the lever mechanism operates independently of a mechanism retaining a user's boot in the binding.

2. The snowboard binding according to claim 1, wherein the lever arm is pivotally connected at a first end thereof to the heel loop; and the link arm is pivotally connected at a first end thereof to the lever arm and at a second end thereof to the highback.

3. The snowboard binding according to claim 2, wherein the link arm is adjustably pivotally connected to the lever arm.

4. The snowboard binding according to claim 2, wherein the lever arm is adjustably pivotally secured to the highback.

5. The snowboard binding according to claim 2, wherein the lever arm, link arm, heel loop and highback form a four bar linkage, the four bar linkage allowing the highback to move between a neutral position and a forward lean position when the lever arm is rotated.

6. The snowboard binding according to claim 2, further comprising:

a plurality of pairs of apertures formed in the lever arm; and a pivot pin, the pivot pin extending through one of the pairs of apertures to pivotally connect the link arm to the lever arm.

7. The snowboard binding according to claim 1, wherein the lever arm is pivotally connected at a first end thereof to the highback; and the link arm is pivotally connected at a first end thereof to the lever arm and at a second end thereof to the heel loop.

8. The snowboard binding according to claim 7, wherein the link arm is adjustably pivotally connected to the lever arm.

9. The snowboard binding according to claim 7, wherein the link arm is adjustably pivotally connected to the highback.

10. The snowboard binding according to claim 7, wherein the lever arm, link arm, heel loop and highback form a four bar linkage, the four bar linkage allowing the highback to move between a neutral position and a forward lean position when the lever arm is rotated.

11. The snowboard binding according to claim 7, further comprising:

a plurality of pairs of apertures formed in the lever arm; and a pivot pin, the pivot pin extending through one of the pairs of apertures to pivotally connect the link arm to the lever arm.

12. The snowboard binding according to claim 1, farther comprising a support member adjustably secured to the highback, the first portion being pivotally connected to the support member.

13. A binding comprising, in combination:

a base plate for attachment to a snowboard;

a heel loop configured to wrap around a heel of a boot, forward ends of the heel loop being rigidly attached to the base plate;

a highback pivotally secured to the heel loop;

a first support member operably engaging the heel loop;

a second support member rigidly attached to the highback;

a lever arm having a first end and a second end, the first end being pivotally connected to one of the first support member and the second support member, the lever arm operating independently of a mechanism retaining a user's boot in the binding; and a link arm having a first end and a second end, the first end being pivotally connected to the lever arm at a location between the first and second ends of the lever arm, the second end being pivotally connected to the other of one of the first support member and the second support member;

wherein grasping and pulling the second end of the lever arm forces the lever arm to pivot about its first end to move the highback between a neutral non-use position and a predetermined forward leaning use position.

* * * * *

UNITED STATES PATENT AND TRADEMARK OFFICE

CERTIFICATE OF CORRECTION

PATENT NO. : 6,406,040 B1
DATED : June 18, 2002
INVENTOR(S) : James Thorne

It is certified that error appears in the above-identified patent and that said Letters Patent is hereby corrected as shown below:

The title page showing the illustrative figure should be deleted to be replaced with the attached title page.

Drawing sheets, consisting of Figs.1-8, should be deleted to be replaced with the drawing sheets, consisting of Figs. 1-8, as shown on the attached page.

Column 6,
Line 13, please kindly delete “arch” and replace it with -- arm --.

Column 7,
Line 4, please kindly delete “farther” and replace it with -- further --.

Signed and Sealed this

Twentieth Day of January, 2004

JON W. DUDAS
*Acting Director of the United States Patent and Trademark Office*

(12) United States Patent
Thorne

(10) Patent No.: US 6,406,040 B1
(45) **Date of Patent: *Jun. 18, 2002**

(54) HIGHBACK SNOWBOARD BINDING

(75) Inventor: James Thorne, Portland, OR (US)

(73) Assignee: Nike, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/176,341

(22) Filed: Oct. 21, 1998

(51) Int. Cl.[7] ..... B62B 9/04

(52) U.S. Cl. ..... 280/14.21; 280/613; 280/618; 36/117.1

(58) Field of Search ..... 280/14.21, 14.22, 280/617, 11.36, 626, 631, 618, 619, 604; 36/117.1, 118.1

(56) References Cited

U.S. PATENT DOCUMENTS

| | | | | | |
|---|---|---|---|---|---|
| 4,081,186 | A | * | 3/1978 | Beyl | 280/618 |
| 4,711,042 | A | * | 12/1987 | Morell et al. | 36/118.1 |
| 5,692,765 | A | | 12/1997 | Laughlin | 280/619 |
| 5,713,587 | A | | 2/1998 | Morrow et al. | 280/14.2 |
| 5,727,797 | A | * | 3/1998 | Bowles | 280/14.2 |
| 5,816,602 | A | * | 10/1998 | Hayashi | 280/604 |
| 5,901,971 | A | * | 5/1999 | Eaton | 280/14.2 |
| 5,975,557 | A | * | 11/1999 | Snoke et al. | 280/624 |
| 6,027,136 | A | * | 2/2000 | Phillips | 280/618 |
| 6,155,577 | A | * | 12/2000 | Okajima | 280/14.2 |

OTHER PUBLICATIONS

K2 Product Brochure, Title and Date Unknown.

* cited by examiner

*Primary Examiner*—Lanna Mai
*Assistant Examiner*—Hau Phan
(74) *Attorney, Agent, or Firm*—Banner & Witcoff, Ltd.

(57) ABSTRACT

A binding has a heel loop and a highback pivotally connected to the heel loop. A lever mechanism has a first portion pivotally connected to the highback and a second portion which operably engages the heel loop. Rotation of the lever mechanism causes the highback to move between a neutral position and a forward lean position. In certain preferred embodiments, the first portion of the lever mechanism is adjustably pivotally connected to the highback. In certain preferred embodiments, the second portion of the lever mechanism is secured to the heel loop.

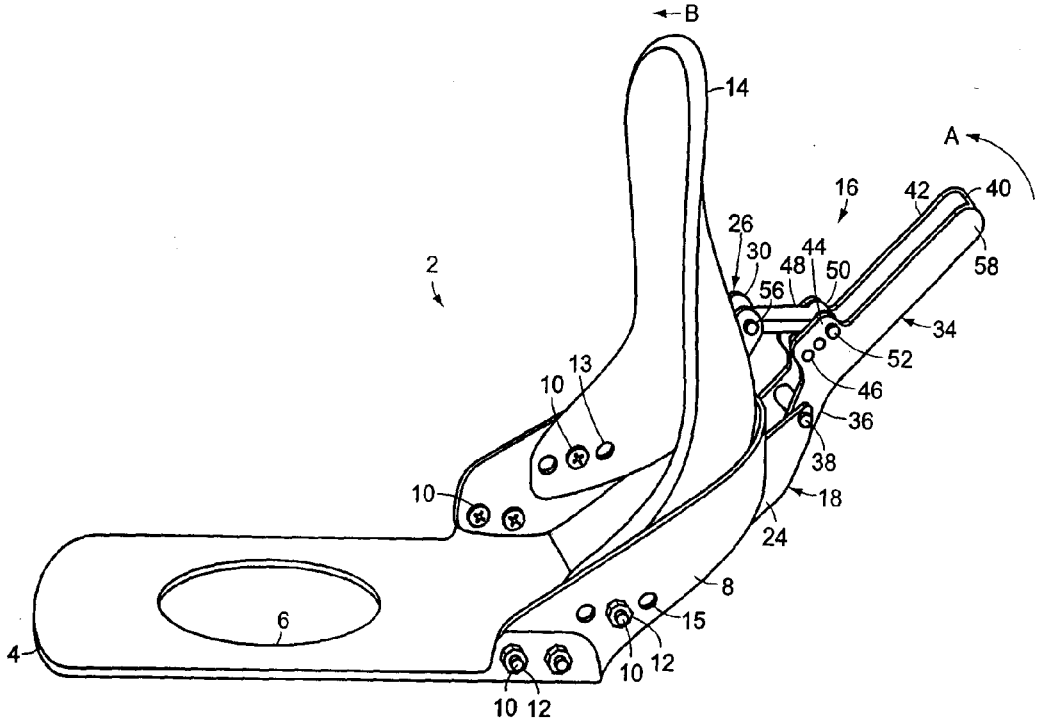

13 Claims, 6 Drawing Sheets